United States Patent [19]

Kubo et al.

[11] 4,256,342

[45] Mar. 17, 1981

[54] DRAGLINE EQUIPPED WITH HOPPER MEANS AND LOADING MEANS

[75] Inventors: Masaaki Kubo, Musashino; Yasutaka Onodera, Kawaguchi; Hiroshi Kawaguchi, Tokyo; Masaharu Sibata, Kawaguchi, all of Japan

[73] Assignee: Mitsubishi Mining & Cement Co., Ltd., Tokyo, Japan

[21] Appl. No.: 948,815

[22] Filed: Oct. 5, 1978

[30] Foreign Application Priority Data

Jul. 1, 1978 [JP] Japan ..... 53-79255

[51] Int. Cl.[3] ..... E02F 7/00

[52] U.S. Cl. ..... 299/7; 37/135; 414/570; 299/64

[58] Field of Search ..... 299/7, 18, 64; 414/520, 414/406, 408, 541, 543; 37/135

[56] References Cited

U.S. PATENT DOCUMENTS

| | | | |
|---|---|---|---|
| 1,996,771 | 4/1935 | Macready | 299/7 |
| 2,060,867 | 11/1936 | Hollerbach | 414/570 |
| 2,144,246 | 1/1939 | Long | 37/135 X |
| 2,761,227 | 9/1956 | Sloane | 414/570 X |
| 2,947,096 | 8/1960 | Cummings et al. | 299/7 X |

FOREIGN PATENT DOCUMENTS

| | | | |
|---|---|---|---|
| 1243957 | 7/1967 | Fed. Rep. of Germany | 299/64 |

*Primary Examiner*—Ernest R. Purser
*Attorney, Agent, or Firm*—Paul J. Sutton

[57] ABSTRACT

A novel dragline is provided which is equipped with hopper means and loading means. More specifically, the dragline of the invention comprises a hopper means mounted on the front portion of a revolving frame rotatably mounted on a mobile base, the hopper means receiving rocks and stones, soil and sand, minerals and the like dug and carried by a bucket, a guide means for guiding the bucket to a position over the hopper means so that the excavated material is loaded into the hopper means, and a loading means disposed below the hopper means for receiving and transferring the material into another transport means, at least the downstream end portion of the loading means being pivotable. The dragline of the invention makes it possible to dig rocks and stones, soil and sand, minerals, etc. in an efficient manner on a large scale and to load them into a transport means.

14 Claims, 17 Drawing Figures

DRAGLINE EQUIPPED WITH HOPPER MEANS AND LOADING MEANS

BACKGROUND OF THE INVENTION

1. Field of the Invention

The present invention relates to a dragline for digging and transporting rock and stones, soil and sand, minerals, etc. (as will be hereinafter called merely rocks and stones), and particularly to a dragline having built-in hopper and loading means for hauling rocks and stones.

2. Prior Art

In recent years there has been a need for high-production and high efficiency excavation methods in large scale land creating works, foreshore reclamation works, surface coal mining works on coal seams having thick overburden, or the like. One conventional method of digging soil and rock in the open air was to effect excavation by a shovel loader and carrying away the excavated material by trucks. Another method was to effect excavation by a bucket wheel excavator and haul the excavated material on a belt conveyor. Any of these prior art methods has been unsatisfactory with respect to the high capacity and efficiency when they were applied to large-scale works. Both the shovel loader and the bucket wheel excavator were inherently limited in size of their shovel or bucket because of their structure, hence they had a limited capacity. In addition they were particularly unsuitable for handling large masses of soil and rock, so that many manhours were required for blasting operations to prevent such large masses from being produced or for boulder blasting operations when great lumps were produced. The aforesaid former method is undesirable especially in excavating places involving bumpy roads because trucks are subject to severe damages.

Digging by the use of a high capacity dragline is known in a vast amount of rock removing work on overlying strata (overburden) above a coal seam as in a strip coal mining. This method provides a very high efficiency and large capacity operation in that the overlying rock as dug by the dragline are dumped and piled directly on the gob or waste area without using any intermediate transport means. However, in mining multiple coal strata having more than two coal seams it may be impossible to carry out the mining operation on the second and lower coal seams when the total thickness of the overlying rock layers exceeds the capacity of a dragline. Practically, therefore, it has been heretofore a usual practice to mine only the first uppermost coal seam even in the case of a multiple coal strata, or at most to dig out the upper layer of rock overlying the first coal seam by a power shovel, haul the excavated material to another place by trucks and then use draglines to dig the overburden of the second coal seam.

Even in the case of a single coal stratum, if there is a large thickness of overburden, there will be a correspondingly increased quantity of waste produced, so that an increased proportion of the waste which has once been dumped at one place must be again transferred to another distant place, resulting in decreasing the efficiency in operation. Furthermore, the boom of a dragline must be swung through an arc of more than 90° up to approximately 180° in operation in order to dump the waste as far as possible, resulting in extending the time required per cycle of the bucket, hence a decreased efficiency. This is due to the dragline's characteristics that despite its great digging capacity the transporting distance is limited to the length of its boom or at most the order of 100 m.

Belt conveyors are known as a large capacity and high efficiency haulage means. Shiftable conveyors capable of lateral movements are particularly suitable for use at a mining area where mobility of the transport means is required. Mining operation is composed primarily of digging and transporting operations. In the past, however, there has been no mining process employed involving a combination of a dragline as described which is a large capacity and high efficiency excavator and a belt conveyor which is likewise a high capacity and high efficiency transporter. One of the reasons is attributed to the dragline's characteristics. That is, since the dragline swings its boom to move its vast bucket filled with the excavated soil and rock (as will hereinafter be referred to as excavated or dug material), the dragline is best suited to dump the excavated material while scattering it over some extent of area. But it has difficulties in dumping the excavated material onto a particular small target such as a hopper or the deck of a truck. If this is to be done, it would take much time to position the dragline itself such that the bucket may be brought to a position directly above the hopper. It would also take a lot of time to bring the bucket to a halt just above the hopper in each cyclic operation between scraping and dumping actions by the bucket, resulting in an extended cycle time of the bucket and a decrease in efficiency. The dragline could not thus exhibit its inherent special performance. Conversely, if the bucket were allowed to dump the material over a considerable extent of region, the hopper should be an enormous one in size enough to receive the moving bucket. Even though it were made possible to hold the bucket size down to a certain extent by spending much time in controlling the movement of the bucket as described above, the bucket would still be of a considerable size and should be capable of movement as the dragline is moved around. Such movable hoppers have not heretofore been proposed.

Another reason that the combination of the dragline and belt conveyor has not been used lies in the belt conveyor. Materials dug often contain big masses of rock or stone. While the dragline can scrape up such big lumps by its vast bucket, ordinary hoppers or belt conveyors cannot accommodate or handle big lumps. For the foregoing reasons any mining system utilizing a combination of draglines and belt conveyors has not been conceived of in the past.

OBJECTS AND SUMMARY OF THE INVENTION

Accordingly, it is an object of the invention to provide a dragline equipped with hopper and loading means capable of digging rocks and stones, soil and sand, minerals, etc. in an efficient manner and on a large scale and loading them into a transport means.

It is another object of the invention to provide a dragline with hopper and loading means in which only a portion of the weight load of the material dug such as rocks and stones, soil and sand, minerals, etc. is imposed on the boom and hoist ropes of the dragline.

It is a further object of the invention to provide a dragline with hopper and loading means in which while a transport means such as a belt conveyor for hauling, the excavated material such as rocks and stones, soil and sand, minerals and the like is fixed in place the material may be loaded into said transport means even if the dragline is moved within a predetermined range of area.

It is still another object of the invention to provide a dragline with hopper and loading means which is capable of digging and transporting rocks and stones, soil and sand, minerals, etc. efficiently and in a large capacity with a relatively short, simple and lightweight boom and hoist ropes as compared with the prior art dragline.

It is a further object of the invention to provide a dragline with hopper and loading means which is of relatively lightweight construction as compared with the conventional dragline.

It is a still further object of the invention to provide a dragline with hopper and loading means which is, when used in conjunction with one or more other similar draglines, particularly useful in digging multiple-strata mine.

The foregoing and other objects and advantages of this invention will become more apparent from the following detailed description.

Briefly, a dragline according to the invention comprises a mobile base, a revolving frame rotatably mounted on the mobile base, a bucket for digging and scooping rocks and stones, soil and sand, minerals and the like therein, a boom mounted on the frame for suspending the bucket therefrom, a hoist rope means passing around the forward end of the boom and connected with the bucket for suspending the latter for vertical movement, and a drag rope means for pulling the bucket toward the revolving frame to excavate the material to be dug and scoop it into the bucket; and the improvement consists in that said dragline includes a hopper means mounted on the front portion of said revolving frame for receiving said excavated material, a guide means for guiding said bucket to a position over the hopper means so that the excavated material is loaded into the hopper means by pulling said drag rope means to lift the bucket, and a loading means disposed below said hopper means for receiving and transferring the material into another transport means, at least the downstream portion of said loading means being pivotable.

BRIEF DESCRIPTION OF THE DRAWINGS

Preferred embodiments of the invention will be described with reference to the accompanying drawings in which.

PREFERRED EMBODIMENTS OF THE INVENTION

Figure 1:
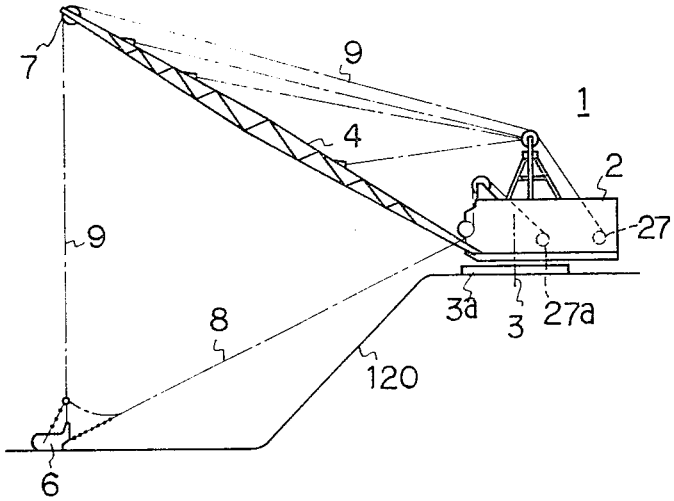
FIG. 1 is a schematic side elevational view of a prior art dragline.
Figure 2:
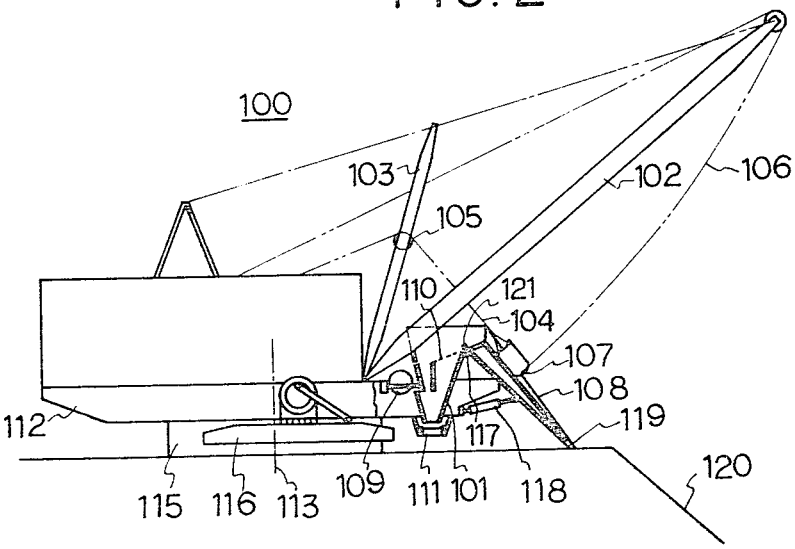
FIG. 2 is a schematic side elevational view, partly in cross-section of an embodiment of the dragline according to the present invention.
Figure 3:
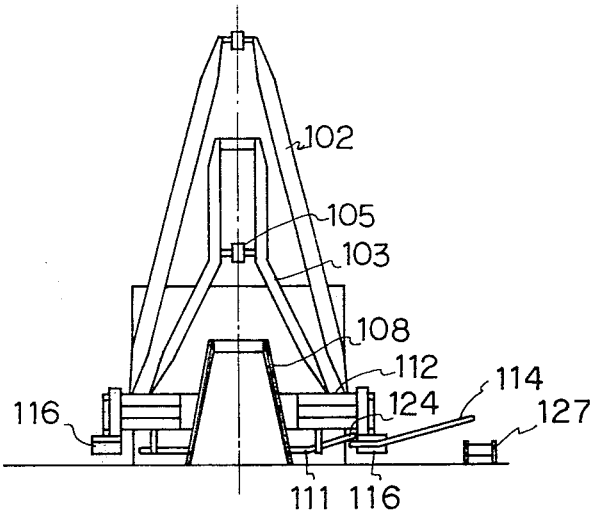
FIG. 3 is a schematic front elevational view of the dragline in FIG. 2.
Figure 5:
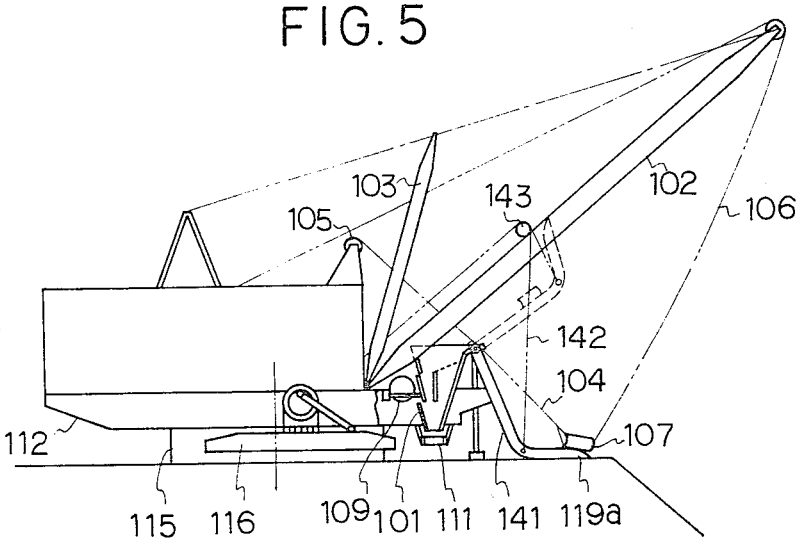
FIG. 5 is a schematic side elevational view, in partly in cross-section of another embodiment of the dragline according to the invention.

Referring to FIG. 1 wherein a prior art dragline 1 is shown, the revolving frame 2 which comprises the main body of the dragline is mounted on a radial base 3*a* for swinging movement in unison with a boom 4 about its own axis 3. Upwardly extending from a hoist rope drum 27 mounted to the revolving frame is a hoist rope 9 which is passed around a head sheave 7 and from the forward end of which is suspended a bucket 6. A drag rope 8 extends from a drag rope drum 27*a* and is also connected to the backet 6. The draglines 100 having built-in hopper and loading means according to the present invention as shown in FIGS. 2, 3 and 5 are of the same construction as the conventional dragline with respect to the construction so far described. The dragline 100 of the invention is therefore applicable to both the conventional crawler and walking types, and may be called a novel dragline having built-in hopper and loading means for loading the material dug into a belt conveyor. More specifically, the dragline 100 according to the invention has a hopper means 101 for receiving excavated material from a bucket 107, said hopper means mounted to the forward portion of a revolving frame 112 which is swingably mounted on a radial base 115. Where the haulage means is a continuously moving belt conveyor, the hopper means 101 is usually only required to have a capacity to accommodate a bucketful of material. Even in an application where trucks are used as the haulage or transport means, the hopper 101 is only required to accommodate two bucketfuls of material. This size of the hopper is such that it is possible to carry the hopper directly on the revolving frame 112. It is preferable that the hopper means 101 be mounted at a location as close to the axis of the revolving frame 112 as possible and at as low an elevation as possible, provided that the center of the hopper means lies on the line of the drag rope 104 as viewed in a plan view and that the hopper means does not interfere with the primary function of the dragline. Disposed above the hopper means 101 is a head sheave 105 for the drag rope, the head sheave being secured to an auxiliary boom 103 for supporting the main boom 102. Being passed around the head sheave 105, the drag rope 104 is adapted to pull the bucket 107 upward to a position over the hopper 101. It is to be understood that the head sheave 105 need not necessarily be attached to the auxiliary boom 103, but it may be affixed to the top of the revolving frame 112 when there is no auxiliary boom provided or depending upon the location of the hopper.

Figure 4:
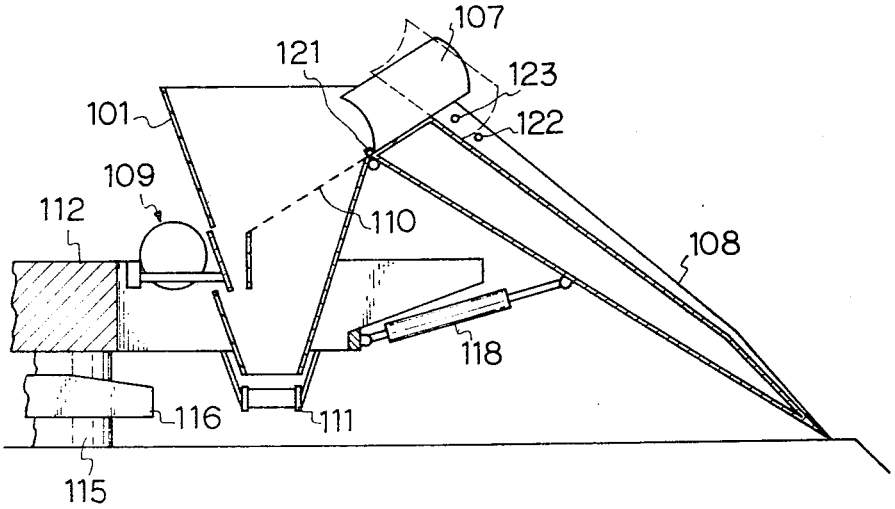
FIG. 4 is a fragmentary enlarged view of the dragline of FIG. 2.

In lifting the bucket filled with excavated material above the hopper it would not be impossible to suspend it upward in the air by pulling both the hoist rope 106 and drag rope 104, but such procedure is not preferable in that there would be difficulties with the control of operation and that great tensions would be imposed on the two ropes. According to this invention an inclined guide plate 108 bridging the upper rim of the hopper 101 and the ground is provided in front of the hopper. The guide plate 108 may be supported by either the hopper or the revolving frame. Preferably the guide plate is connected at its upper end to the upper portion of the hopper by means of hinge means 117 and connected adjacent its lower end to an extensible hydraulic cylinder 118 which is secured to the revolving frame 112 so that the lower end 119 of the guide plate 108 may be vertically pivotable about the hinge means 117. With this arrangement, the guide plate 108 may be lifted up from the ground while the dragline 100 is moved. On the other hand, during the digging operation the guide plate may be rested on the ground and adjusted so as to accommodate the undulations of the ground. Further, the guide plate 108 may be flared downward as viewed in a front view shown in FIG. 3 so as to facilitate the receipt of the bucket 107. However, even if such flaring is of a slight extent, the guide plate assures receipt of the bucket therein as the guide plate is swung together with the booms 102, 103 and always lies on the path of travel of the bucket. The bucket 107 is pulled upward along the digging surface 120 which constitutes a ramp and then along the guide plate 108 by the drag rope 104 to reach the upper rim of the hopper 101 whereupon the drag rope is released to allow the bucket to tilt forward by gravity to thereby dump the excavated material into the hopper 101. It should be noted that an upstanding stop member 121 is provided on the hopper 101 to prevent the bucket from falling into the hopper. It is desirable that the operation of halting and relaxing the drag rope 104 be automatically controlled since the manual control would involve complex procedures and difficulties in timing the rope halting and relaxing operations. The automatic control may be accomplished according to the paid out length of the rope 104, but the use of photoelectric sensors 122, 123 disposed at the side of the upper portion of the guide plate 104 for detecting the passage of the bucket as shown in FIG. 4 may be more advantageous because it assures positive operation and requires less complex equipment. With the arrangement in FIG. 4, as the bucket 107 arrives at the photoelectric sensor h122, the drag rope drum (not shown) is stopped while the bucket continues to rise by inertia to some extent to reach the photoelectric sensor 123 whereupon the drag rope is relaxed to tilt the bucket toward the hopper 101 for dumping the excavated material. Infrared type position sensing devices may be particularly desirable as such photoelectric sensors.

Considering the movement of the hoist rope 106 in the meanwhile, the hoist rope remains relaxed and merely follows the moving bucket 107 until the bucket is lifted by the drag rope 104 for dumping whereupon the hoist rope 106 is wound up while the drag rope is paid out to return the bucket to its digging position. It is thus to be appreciated that with the dragline of this invention no more than the load of the empty bucket is imposed on the hoist rope during the usual operation of the dragline. This enables simplified construction of boom means 102, 103 and hoist rope 106 as compared with the prior art dragline 1.

FIG. 5 illustrates another modified embodiment of the invention in which the bucket guide means comprises a L-shaped plate 141 having a guide plate section hinged at its upper end to the top of the hopper 101 and a lower horizontally extending flat section resting on the ground at its lower end 119*a* for receiving the bucket, and a hoist means for lifting the lower section of the L-shaped plate, said hoist means comprising a rope 142, a head sheave 143 for the rope and a hoist (not shown). With this arrangement, the bucket 107 is pulled along the digging face 120 by the drag rope 104 to mount the horizontal section of the L-shaped plate 141. The hoist rope 142 connected to the L-shaped plate is then wound up to swing the L-shaped plate upward as shown in phantom lines in FIG. 5, so that the material dug falls down the L-shaped plate 141 and is dumped into the hopper 101. Upon completion of the dumping, the L-shaped plate is swung downward and the hoist rope 106 is wound up to return the empty bucket 107 to the digging position.

In this manner a cycle of steps from digging by the bucket to dumping into the hopper is completed. While continuing with such digging operation, the dragline 100 rotates its revolving frame 112 to move the digging position incrementally to dig the sectoral area within the dragline's reach from its fixed position.

Figure 6:
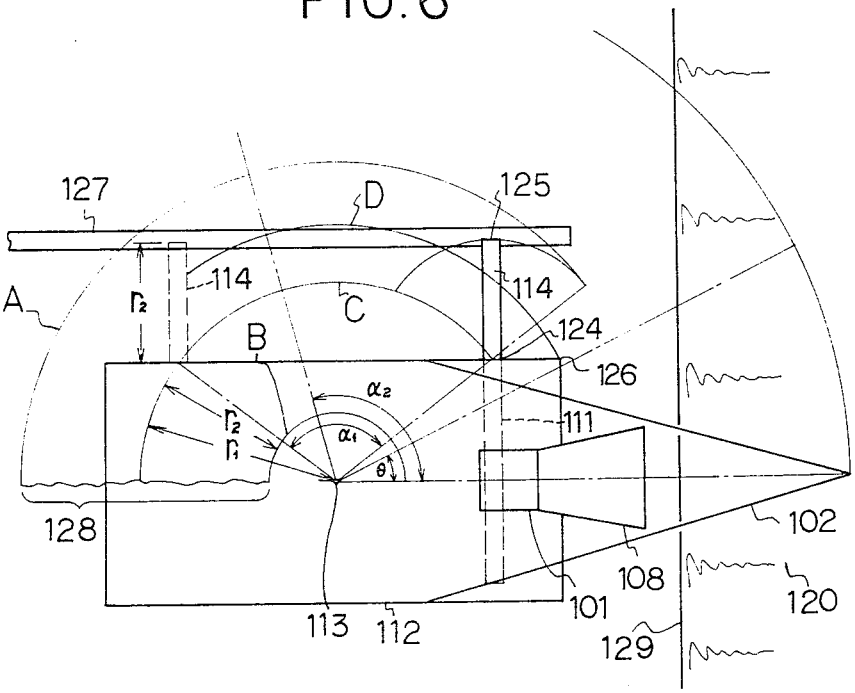
FIG. 6 is a plan view illustrating the relation between the swinging dragline and an associated belt conveyor.

Disposed below the hopper 101 is a loading means at least the forward or downstream portion of which is swingable, said loading means adapted to receive the dug material from the hopper and load it into another belt conveyor. As shown in FIG. 6, the hopper 101 is mounted to the front portion of the revolving frame 112 at a location offset with respect to the axis 113 of rotation of the frame so that as the revolving frame rotates the hopper also swings about the axis 113. Accordingly, in order for the dragline to perform the continuous operation while swinging the revolving frame, it is required to provide a loading means connecting the swinging hopper 101 and the straight belt conveyor 127 fixed in place. To this end the present invention provides a loading means disposed below the hopper at least the forward or downstream portion of which loading means is pivotably mounted.

The loading means will now be described in detail. It is possible to geometrically determine the scope of location of the belt conveyor in which the conveyor is capable of receiving the excavated material from the loading means and yet does not interfere with the rotating movement of the revolving frame. The loading means as shown in FIGS. 2–6 comprises a fixed conveyor section 111 carried by the revolving frame 112 beneath the hopper 101 and a swingable conveyor section 114 extending downstream of and pivotally connected to said upstream fixed conveyor section. Referring to FIG. 6, as the revolving frame 112 swings about to its axis 113, the outer or downstream end 124 of the fixed conveyor section also moves about the axis 113. The swingable conveyor section 114 is swingable about the distal end 124 of the fixed conveyor section. Thus, the loci as described by the outer end 125 of the swinging conveyor section 114 during the combined swinging movements of the fixed and pivotal conveyor sections 111, 114 are an annulus 128 having a width of 2 times the radius $r_2$ of rotation of the swingable conveyor 114, said annulus being defined by envelopes of circles with a radius $r_2$ and with its center on the circle C described by the outer end 124 of the fixed conveyor section about the axis 113. In other words, the distal end 125 of the swingable conveyor section can move within the annulus 128 defined by a circle (A) with a radius $(r_1+r_2)$ and a circle (C) with a radius $(r_1-r_2)$. Therefore, if the belt conveyor 127 is installed so as to partly overlap the annulus 128, the discharge end 125 of the swingable conveyor section is capable of loading the excavated material onto the belt conveyor 127 while moving along the latter without being dislodged therefrom in that section of the belt conveyor 127 overlapping the annulus 128 by permitting the pivotally mounted conveyor section 114 to swing with the rotation of the revolving frame 112. In other words, the limits of angular movements of the revolving frame are defined by that section of the belt conveyor 127 overlapping the annulus 128. The extent of the permissible angular movements is increased with a decrease in the radius $r_1$ of rotation of the outer end 124 of the fixed conveyor section and with an increase in the radius $r_2$ of rotation of the swingable conveyor section 114.

While the foregoing explanation has been made for the purpose of illustration assuming that there were no other limitations, due regard should be paid to limitations involved in actual operation. In FIG. 6, for example, the belt conveyor 127 must be installed outside of a circle (D) described by the adjacent forward corner 126 of the revolving frame 112 so that the belt conveyor may not interfere with the revolving frame as it rotates about its axis. If the belt conveyor 127 is installed with its longitudinal axis perpendicular to the upper edge 129 of the working surface 120, the scope of angular movement of the revolving frame 112 is limited to the angle $\alpha_2$ equivalent to the angle $\alpha_1$ (shown in dotted lines) of arcuate movement of the outer end 124 of the fixed conveyor section. On the other hand, considering the angle $\theta$ through which the revolving frame 112 is required to rotate for the digging operation by the bucket, it is not desirable from a viewpoint of efficiency in the digging operation that the revolving frame is swung too far away from the position confronting the digging surface 120, since the distance which the forward end of the boom can cover outwardly away from the upper edge 129 of the digging surface is correspondingly reduced. Inasmuch as the permissible rotational angle $\alpha_2$ of the revolving frame is usually greater than the required rotational angle $\theta$, there is no possibility that the digging operation by the bucket is restricted by the relationship between the pivotable conveyor section 114 and the belt conveyor 127. Further, while the revolving frame 112 is shown as capable of rotating only to the left in FIG. 6, the frame may be arranged to rotate to the right as well either by orienting the longitudinal axis of the belt conveyor 127 at an angle to the upper edge 129 of the digging surface 120 or by prolonging the length of the belt conveyor 127 forward as well as the length of the pivotable conveyor section 114.

As an alternative for the combination of the fixed conveyor section and pivotable conveyor section 114, the loaing means may comprise a combination of a fixed conveyor section and a swingable chute in substitution for the pivotable conveyor section, said chute being connected to the downstream end of the fixed conveyor section where the dragline 100 is of a relatively small size with the fixed conveyor section 111 having a correspondingly short radius or where a particular selected mode of digging requires only a small rotational angle of the revolving frame 112.

Figure 7:
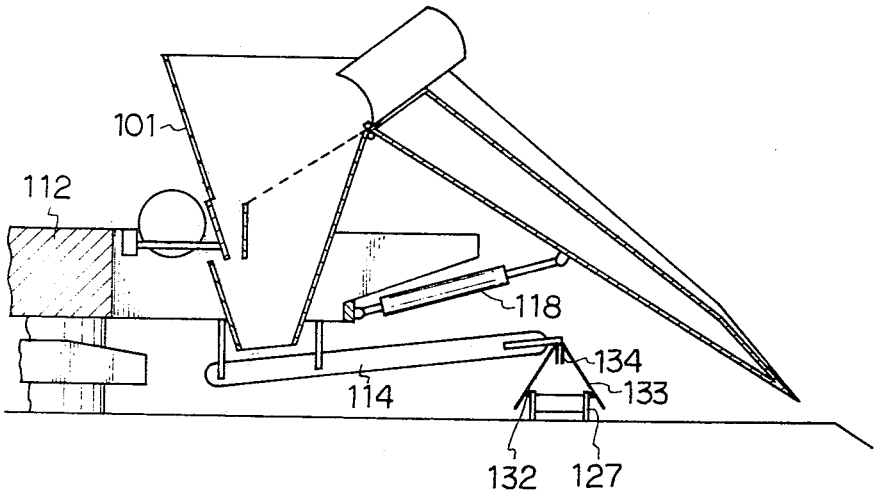
FIGS. 7 and 8 are schematic vertical sectional views of alternate forms of loading means.
Figure 8:
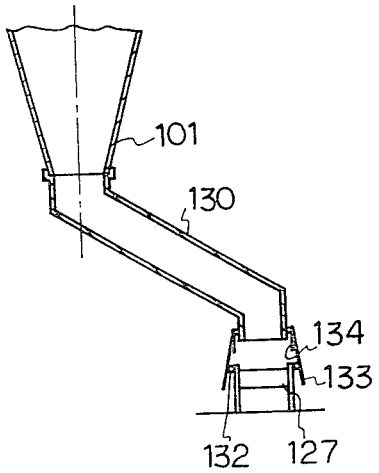

Several modified forms of the loading means will be described in detail below. If the belt conveyor 127 is installed adjacent and forward of the revolving frame 112 generally in parallel to the upper edge 129 of the digging face as shown in FIG. 7, a pivotable conveyor 114 may be mounted directly below the hopper 101. Further, where it is possible to provide a relatively high drop height between the lower end of the hopper and the belt conveyor 127, a swingable chute 130 may be connected to the lower end of the hopper for discharging onto the belt conveyor 127 as shown in FIG. 8. It will be noted that these forms of the loading means may also perform the loading function on the same principle as described in connection with the embodiment of FIG. 6 without undergoing any interference from the rotation of the revolving frame. The fixed conveyor 111, pivotable conveyor 114 and swingable chute 130 for use on the loading means described may be of suitable conventional construction.

Figure 9:
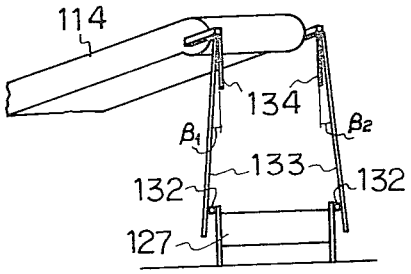
FIG. 9 is a front view of a sensor means for detecting the misalignment of the loading means.
Figure 10:
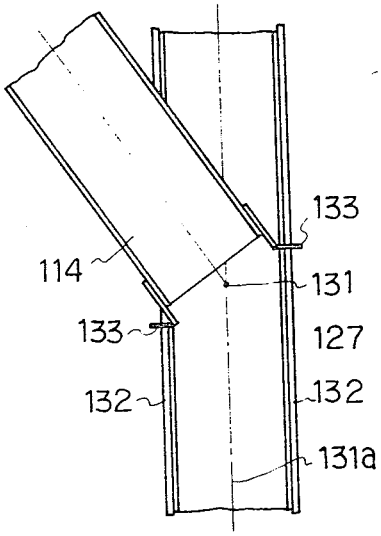
FIG. 10 is a plan view of the sensor means of FIG. 9.
Figure 11:
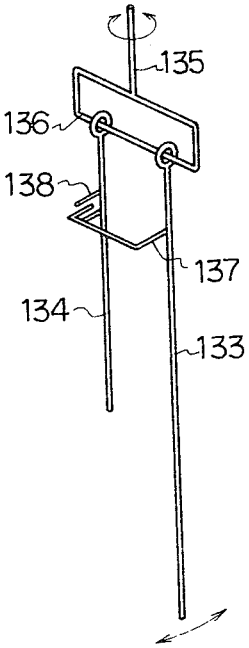
FIG. 11 is a detailed view of the sensor means in FIG. 9.

It is necessary to control the loading means so as to always maintain the discharge end of the loading means aligned with the central axis of the belt conveyor while the revolving frame is being rotated. It is preferable that such control be automatically accomplished since it is very troublesome, although possible, for the operator to perform the manual control while observing the outer end of the loading means. Such automatic control may be accomplished by detecting the positional relation between the outer end of the loading means and the belt conveyor 127 optically, mechanically or electrically. According to the present invention, as shown in FIGS. 9 and 10, a pair of sensing rods 133, 133 are rotatably suspended from the outer end of the loading means (pivotable conveyor section 114 in the illustrated embodiment) on opposite sides of and at equal distances from the center 131 of fall of the excavated material from the loading means, the spacing between the pair of sensing rods being smaller than that between a pair of guide bars 132, 132 provided along opposite side edge of the belt conveyor 127 so that the sensing rods are contacted by the associated guide bars. The deviation of the center of fall 131 of the material from the center line 131*a* of the belt conveyor is detected by offset angles $\beta_1$ and $\beta_2$ of the two sensing rods from the vertical line to perform the automatic control so as to correct the position of the pivotable conveyor section 114. As both the guide bars 132 and sensing rods 133 are made of smooth surface rods or pipes such as stainless steel, the sensing rods 133 contact the guide bars 132 perpendicularly to the latter even when the swinging conveyor section 114 intersect obliquely with the belt conveyor 127 as shown in FIGS. 9 and 10. A pair of reference rods 134, 134 are vertically suspended adjacent the associated sensing rods 133 as seen in FIG. 9 so that angles $\beta_1$, $\beta_2$ formed between the reference rods and sensing rods may be detected to determine the deviation of the pivotable conveyor section 114 from the center of fall 131 of the excavated material on the basis of the difference between the detected angles $\beta_1$ and $\beta_2$. The swingable conveyor section 114 is controlled in a sense to make the angles $\beta_1$ and $\beta_2$ coincident. Thus, when $\beta_1 > \beta_2$, the pivotable conveyor section should be swung toward the $\beta_1$ side, and vice versa.

In order to detect the angle of the sensing rod 133 with respect to the reference rod 134, a shaft 135 rotatable about a vertical line and having cross bar means 136 secured thereto may be provided. The sensing rod 133 and reference rod 134 are rotatably suspended from the cross bar means 136. Extending from the sensing rod 133 and reference rod 134 are arms 137 and 138, respectively which are opposed to each other to form a pulse generator. A relative movement between the arms 137 and 138 occurring with a deflection of the sensing rod 133 produces a number of pulses proportional to the amount of the movement which pulses are used to control the swinging of the loading means. Two sets of sensing rods 133 and reference rods 134 may also be arranged such that the two sensing rods and two reference rods are aligned along a line perpendicular to the longitudinal axis of the belt conveyor 127 as shown in FIG. 8.

Depending upon the condition of the area to be dug, the material dug may contain large masses or lumps which obstruct the smooth transportation of the material through the hopper and on the conveyor. In such instance an inclined sieve 110 may be disposed in the upper portion of the hopper 101 as shown in FIG. 4 to separate large masses which may be broken down by a crusher 109 provided at the discharge end of the inclined sieve. The inclined sieve and crusher may both be of conventional construction. For the crusher a relatively small size and large capacity jaw crusher is suitable. In addition, it is preferable that the outlet of the crusher be adapted to lead back to the hopper 101 to discharge the crushed material through the common single discharge end of the hopper to thereby simplify the construction, particularly when the loading means is swingably mounted below the hopper.

In the construction of the dragline 100 of this invention having such equipment as the hopper 101, crusher 109, etc. mounted on the forward central portion of the revolving frame 112, the root of the boom 102, if it is located at the central front of said frame, would provide an obstacle to mounting said equipment. To avoid such situation, the lower portion of the boom is preferably in the form of downwardly diverging inverted V-shaped or inverted U-shaped or inverted Y-shaped configuration in a front view as seen in FIG. 3.

The prior art dragline was equipped with a very long boom to dump the material dug as far as possible whereas the dragline of the invention only requires a boom having a length just necessary for the digging operation because the material dug is transported by the built-in conveyor means. The digging operation usually takes place on the sloped working face 120. The length of the boom required for the digging operation is approximately half the length of boom required for dumping the dug material. Accordingly, even though the reduction in the effective length of the boom due to the existence of the hopper and guide means is taken into account, the length of the boom of the dragline according to the invention may be substantilly shortened as compared with the boom of the prior art dragline. Furthermore, as indicated hereinbefore no more than the load of the empty bucket is imposed on the hoist rope 106. Thus, not only the boom length is shortened, but also the load on the forward end of the boom is decreased, resulting in a substantial decrease in the moment on the dragline (the boom length times the load). Therefore, the required strength of the boom may be reduced, permitting the use of a compact and light weight boom. Moreover, the reduced moment permits the use of a substantially lightened counterweight for maintaining the balance of the dragline. This more than makes up for the weight increased by addition of the hopper, crusher, guide means, etc.

With the dragline of the invention wherein the material dug is dumped into the hopper mounted on the revolving frame without the need for swinging the boom through 90° to 180° for each dumping operation as with the conventional dragline, the time required for one cycle of the bucket operation is greatly reduced, resulting in an increase in the capacity of the dragline. Conversely, for a given capacity, the dragline may be reduced in size.

Figure 12:
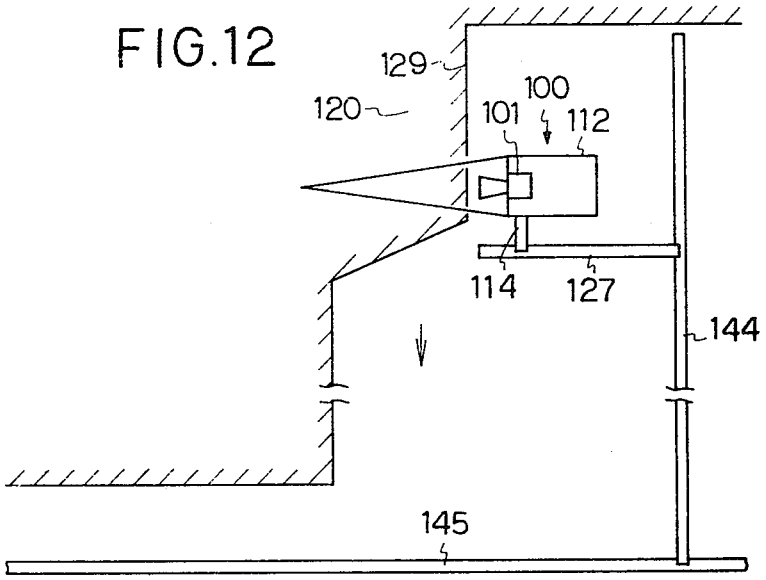
FIGS. 12 to 15 are schematic plan views illustrating a method of digging by the use of a combination of the dragline of the invention and a belt conveyor.

The method of digging stones and rocks or the like by the combination of the hopper-equipped dragline of the invention and belt conveyor means will next be described. FIG. 12 is a plane view of the entire digging site in which a main belt conveyor 145 is installed along a partition line of the digging site. The dragline 100 is positioned face to face with the upper edge 129 of the digging face 120 with its swingable conveyor section 114 extending to the left. Installed along the left side of the dragline approximately perpendicularly to the upper edge 129 of the digging face is a first intermediate belt conveyor 127 for hauling the excavated material rearward. The rearward end of the first intermediate conveyor is connected to a second intermediate conveyor 144 which in turn leads to the main belt conveyor 145.

In FIG. 12 the digging operation proceeds towards the second intermediate belt conveyor 144 as a whole while proceeding towards the main belt conveyor 145 in a direction indicated by an arrow as viewed locally. The dragline 100 proceeds with digging while swinging from the front of the digging face to the left. The digging operation can be continuously carried out as the swingable conveyor 114 swings following the rotational movement of the revolving frame 112 so as to maintain the connection with the first intermediate belt conveyor 127 as described hereinbefore. Upon finishing the digging over a certain lot of area, the dragline 100 is moved towards the main belt conveyor 127 to dig a new lot. To move the dragline the first intermediate belt conveyor 127 must first be moved. To this end, the first intermediate belt conveyor may comprise a transferable belt conveyor such as a shiftable conveyor or transfer wagon. After shifting the first intermediate belt conveyor, the dragline is moved on its walking feet 116 (FIG. 3) lowered against the ground to continue with digging in the same manner as described above. Upon reaching the terminal end of the digging area, the dragline 100 and the first intermediate belt conveyor are moved back to the opposite end (upper end as viewed in FIG. 12) of the area and at the same time the second intermediate belt conveyor is moved by one cut width to the right or rearward. Therefore, the second intermediate belt conveyor should also be a transferable belt conveyor such as a shiftable conveyor.

Figure 13:
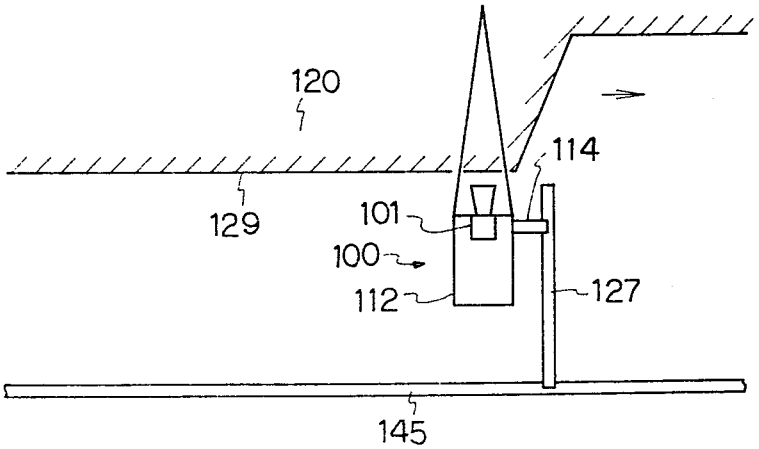

FIG. 13 shows an application in which the dragline 100 is moved parallel to the digging area. This mode of digging requires only one intermediate conveyor and is suitable for a digging area having a narrow width.

Figure 14:
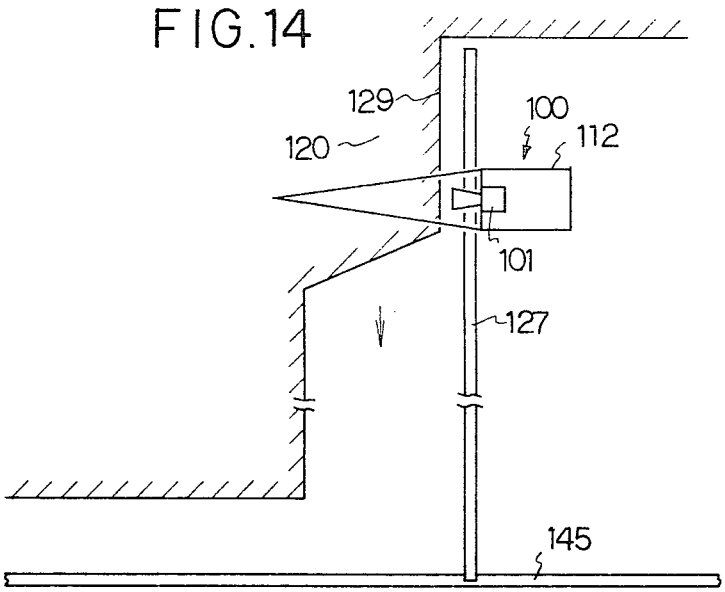
Figure 15:
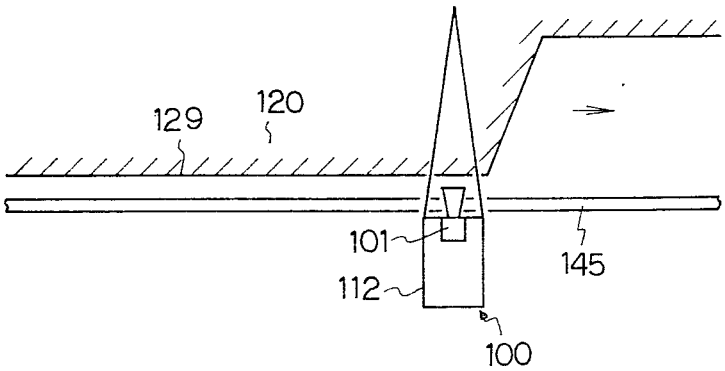

In an application shown in FIGS. 14 and 15 the intermediate conveyor 127 is installed forward of the dragline 100 and the loading means comprises a swingable conveyor or swingable chute as described with reference to FIGS. 7 and 8. This mode of digging is characterized in that the revolving frame is permitted to rotate equally either to the left or to the right and that little or no intermediate belt conveyor is needed. Particularly the application in FIG. 15 requires no intermediate belt conveyor whatsoever and hence does not involve the operation of transferring the intermediate conveyor. This is especially suitable for digging a narrow strip of area.

It is thus to be appreciated that the method of digging according to this invention enables the operation of loading the material from the dragline directly onto another transport means as was impossible with the prior art dragline. While the invention has been described with reference to the application wherein the excavated material of the dragline is loaded onto a blet conveyor, the material may be hauled by trucks by positioning trucks below the loading means of the dragline. Therefore, in contrast to the prior art dragline which was used only in dumping the excavated material just rearward of the dragline as in removing an overburden on a coal seam, the digging method using the dragline of this invention makes it possible to transport the excavated material to a remote place and is extensively applicable to mining of useful minerals such as iron ore, limestone or the like and harvesting stones and sand.

Figure 16:
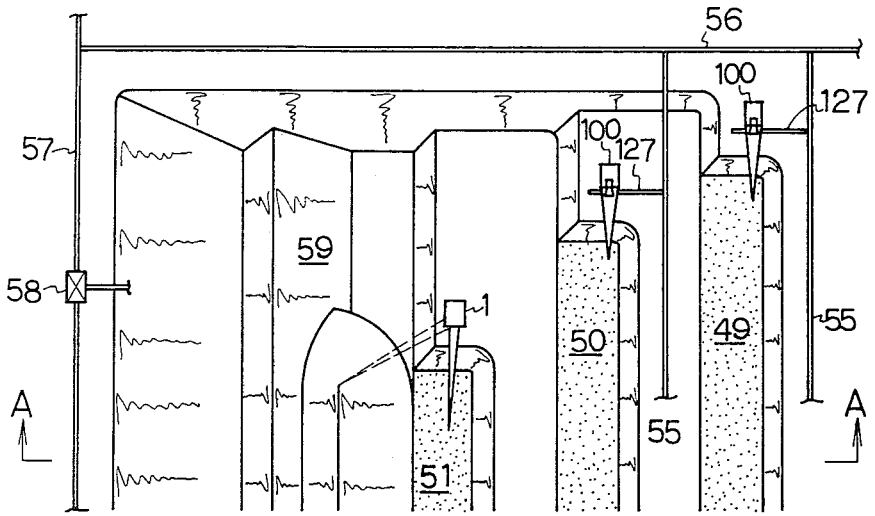
FIG. 16 is a schematic plan view showing a method of digging the overburdens of coal means in a three-strata coal mine.
Figure 17:
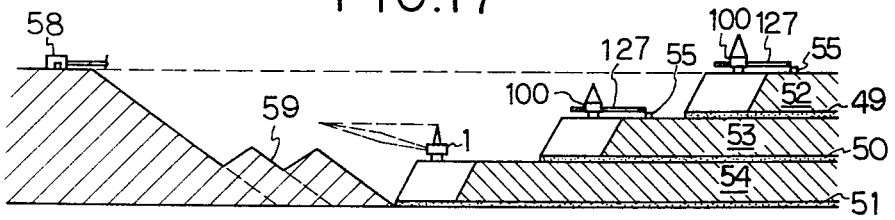
FIG. 17 is a sectional view taken along the line A—A in FIG. 16.

A method of applying the foregoing digging method to the mining of a multiple-strata coal mine will be described below. This invention provides a method of mining a multiple-strata coal mine comprising the steps of digging an overburden overlying the lowermost coal seam by a prior art dragline and depositing the material dug directly on the dug area of said lowermost coal seam; and digging overburdens of coal seams above the lowermost coal seam by respective draglines of this invention and loading and hauling the material dug on the associated belt conveyors installed parallel to the associated lots of the mining area. This method will be described in detail with reference to the drawings. FIG. 16 is a plan view of a stope in which three-strata coal seams are simultaneously mined and FIG. 17 is a sectional view taken on the line (A)—(A) in FIG. 16. The coal seams are called first, second and third coal seams 49, 50 and 51 in the order from the top downward, and the earth layers overlying the respective coal seams are called first, second and third overburdens 52, 53 and 54. The stratum comprising the first coal seam and first overburden is referred to as first stratum. The two similar lower strata are termed second and third strata. A dragline according to the present invention 100, face conveyor 55 and an intermediate conveyor 127 are installed on each of the first and second overburdens 52, 53. Extending along the outer boundary of the mining area is a second conveyor 56 which is disposed generally perpendicularly to the face conveyors 55 and into which the face conveyors discharge. Further, a gob conveyor 57 is laid at the gob or waste area to receive the discharge from the second conveyor and is discharged into a stacker 58 for spreading the dug material over the gob 59 from which the coal has already been extracted.

While the combination of the draglines of the invention and the belt conveyors may take various forms as described above with respect to FIGS. 12 to 15, one example employing the combination shown in FIG. 12 will be explained here just for the purpose of illustration. It is to be noted that on the third overburden a prior art dragline 1 alone is installed. In general, shiftable belt conveyors are preferably used for the face conveyor 55 and gob conveyor 57 while the second conveyor 56 may preferably be a fixed conveyor. Furthermore, when a relatively large proportion of big lumps is contained in the material dug, the dragline 100 of the invention is provided with an inclined sieve 110 and crusher 109.

The digging is carried out successively with the first, second and third strata in the order named. The digging of each stratum proceeds from the starting point (not shown) towards the second conveyor 56 along the face conveyor 55 usually with a cutting width of 30 to 50 m. First, the first overburden 52 is broken to fragments by blasting and then dug and loaded by the hopper-equipped dragline 100 of the invention through the intermediate belt conveyor 127 onto the face conveyor 55 in the same procedures as described hereinabove in connection with FIG. 12. The excavated material is then transferred via the second conveyor 56 and gob conveyor 57 and dumped through the stacker 58 to a location behind the mining area. Upon completion of the digging within the range of the hopper-equipped dragline 100 from a fixed position, the dragline is moved along the intermediate belt conveyor 127 to dig the next adjacent portion of the mining lot. When the digging has thus been carried out to the boundary line parallel to the face conveyor 55, the dragline and intermediate belt conveyor 127 are transferred backward to continue with the digging in the same manner. When an appropriate length (usually 100 to 200 m) of the first coal seam 49 immediately below the first overburden 52 has been exposed, the mining of the first coal seam is initiated from the remote end thereof to proceed toward the working face of the first overburden. The extraction of coal may be effected by any conventional mining method using exposives, power shovels, trucks, etc. (any of them not shown). As the digging operation has proceeded to the terminal edge of the mining area adjacent the second conveyor, the equipment such as the face conveyor 55, intermediate belt conveyor 127 and the dragline 100 of the invention are transferred to the adjacent second zone of the first stratum to dig the second cutting zone from the starting end toward the second conveyor. In this way the first stratum continues to be dug one zone after another.

Upon the digging and mining of the first stratum having thus proceeded to a certain extent, the digging of the second stratum is initiated with a space equivalent to one or two cutting widths from that one of the first stratum in process of digging. The spacing of one or two cutting widths insures a space for laying a face conveyor for the second overburden digging as well as isolating the second stratum from the influence of blasting in the first stratum. The digging of the second stratum is effected in the same way as the first stratum. Upon digging of the second stratum having proceeded for a few cutting zones, the digging of the third stratum is started. The third overburden is first excavated. In this case, however, it should be noted that the excavated material is dumped over the gob area 59 directly by the conventional dragline 1 without using a face conveyor. The other operations are the same as the digging of the first and second strata.

As explained above, the digging of the first, second and third strata simultaneously proceeds such that each succeeding stratum follows the immediately preceding one. The excavated material from the third overburden is piled on the waste area of the third stratum to fill it in the wake of the progressively worked third stratum. The excavated materials from the first and second overburdens are piled successively on the excavated material of the third overburden previously dumped on the waste area. Accordingly, as the digging of the various strata proceeds, the gob conveyor 57 is transferred progressively forward. The entire mining area is thus a system moving parallel in an orderly manner which provides a very high efficiency in operation with shortened distances of travel through which the material dug is hauled and a minimum working space required for the mining operations.

From the foregoing it is to be appreciated that the mining method using draglines and belt conveyors enables the mining of multiple-strata coal seams which has heretofore been impossible with the prior art method using draglines alone.

The present invention is not restricted to the embodiments herein illustrated but may be practised in many different forms without departing from the spirit and scope of the invention. By way of example, even in the case of a single stratum coal seam, if the overburden above the coal seam is so thick as to exceed the working capacity, the digging of the overburden may be effected efficiently by dividing the overburden into an appropriate number of layers so that the multiple-strata digging method of this invention may be used. Since the efficiency of the surface mining depends for the most part on the efficiency of digging an overburden, the industrial value of this invention is considered very high.

Although the present invention has been described with particular reference to preferred embodiments, it will be apparent to those skilled in the art that variations and modifications may be made without departing from the essential spirit and scope of the invention. It is intended to include all such variations and modifications.

What is claimed is:

1. A dragline comprising a mobile base, a revolving frame rotatably mounted on the mobile base, a bucket for digging and scooping rocks and stones, soil and sand, minerals and the like therein, a boom mounted on the revolving frame for suspending the bucket therefrom, a hoist rope means passed around the forward end of the boom and connected with the bucket for suspending the latter for vertical movement, a drag rope means for pulling the bucket toward the revolving frame to excavate the material to be dug and scoop it into the bucket, a hooper means mounted on the front portion of said revolving frame for receiving said excavated material, a guide means for guiding said bucket to a position over the hopper means so that the excavated material is loaded into the hopper means by pulling said drag rope means to lift the bucket, and a loading means disposed below said hopper means for receiving and transferring the material into a conveyor, at least the downstream end portion of the loading means being pivotable and provided with control means for controlling the pivotal movement of said downstream end portion so that the center of fall of the excavated material from the downstream end portion lies on the longitudinal center line of said conveyor.

2. A dragline according to claim 1 wherein said guide means comprises a guide plate inclined forwardly and downwardly from the top of said hopper means.

3. A dragline according to claim 2 further including lifting means for lifting said guide plate while said dragline is moved and lowering the guide plate during the operation of the dragline.

4. A dragline according to claim 1 wherein said guide means comprises a L-shaped plate composed of a flat section resting on the ground and a guide plate section inclined downwardly from the top of said hopper means, and a lifting means for lifting said L-shaped plate above said hopper means upon the bucket being received onto said flat section and the pulling of said drag rope being halted so that the excavated material in the bucket is caused to fall down into the hopper means.

5. A dragline according to claim 3 or 4 wherein said lifting means is operated by fluid-operated cylinder means.

6. A dragline according to claim 3 or 4 wherein said lifting means is operated by sheave means mounted to said boom, rope means connected through said sheave means to said lifting means, and drive means for winding up and paying out the rope means.

7. A dragline according to claim 1 wherein said guide means is provided with sensor means for detecting the passage of said bucket, and further including automatic control means for controlling the winding-up operation of said drag rope according to a signal from said sensor means so as to bring the bucket to a position above said hopper means and to dump the excavated material from the bucket into the hopper means.

8. A dragline according to claim 1 wherein said loading means comprises a fixed conveyor section fixedly carried by said revolving frame and/or said hopper means, and a swingable conveyor section pivotally connected to the downstream end of said fixed conveyor section for receiving the excavated material from the fixed conveyor section and transporting and loading it into said conveyor.

9. A dragline according to claim 1 wherein said loading means comprises a fixed conveyor section fixedly carried by said revolving frame and/or said hopper means, and a swingable chute pivotally connected to the downstream end of said fixed conveyor section for receiving the excavated material from the fixed conveyor section and transporting and loading it into said conveyor.

10. A dragline according to claim 1 wherein said loading means comprises a swingable conveyor pivotally mounted and adapted to receive the excavated material from said hopper means and transporting and loading it into said conveyor.

11. A dragline according to claim 1 wherein said loading means comprises a swingable chute pivotally mounted and adapted to receive the excavated material from said hopper means and transporting and loading it into said conveyor.

12. A dragline according to claim 1 wherein said control means comprises a pair of guide bars secured to said conveyor along its opposite sides, at least two sensing rods rotatably mounted adjacent and at a predetermined distance from said center of fall of the excavated material so as to slidingly contact the associated guide bars, a reference rod mounted adjacent the mounting of said each sensing rod and adapted to assume a vertical position under the influence of gravity, and detecting and driving means for comparing at least two angles formed between said sensing and reference rods and rotating said swingable portion of said loading means according to the differential in said two angles so that said center of fall of the material is brought to the longitudinal center line of said conveyor.

13. A dragline according to claim 1 wherein said hopper means includes a sieve for separating relatively large lumps from said excavated material, and a crusher for breaking to pieces the large lumps separated by said sieve.

14. A dragline according to claim 13 wherein the broken pieces from said crusher are passed into the discharge opening of said hopper means.

* * * * *